US005545087A

United States Patent [19]

Seward

[11] Patent Number: 5,545,087

[45] Date of Patent: Aug. 13, 1996

[54] STORAGE POCKETS FOR FILE FOLDERS

[76] Inventor: Eric Seward, 1528 Walnut #3, Berkeley, Calif. 94709

[21] Appl. No.: 233,063

[22] Filed: Apr. 26, 1994

[51] Int. Cl.[6] ..... B41L 1/26

[52] U.S. Cl. ..... 462/6; 462/64

[58] Field of Search ..... 281/38, 31; 462/64, 462/6; 40/359; 206/425

[56] References Cited

U.S. PATENT DOCUMENTS

| | | | |
|---|---|---|---|
| 5,160,296 | 11/1992 | Katz | 40/359 X |
| 5,311,685 | 5/1994 | Wyant | 40/359 |
| 5,393,157 | 2/1995 | Basmajian | 281/38 X |

OTHER PUBLICATIONS

Globe–Weis, File works Hanging File Disk Pocket & Business Card Pocket; ©1994 Atapco Office Group.

*Primary Examiner*—Willmon Fridie, Jr.

*Attorney, Agent, or Firm*—Glen R. Grunewald

[57] ABSTRACT

A storage pocket and assemblage thereof, for storing business cards, credit cards, floppy discs, photographs, and other flat cardlike objects, to be used in conjunction with hanging and non-hanging file folders and the like. To allow simultaneous access to flat cardlike objects and pertinent documents stored within the file folder, in lieu of two separated means of storage. In preferred embodiment a single sheet of semi-flexible material with a multitude of folds forming a flexible storage pocket. Each such pocket having opposing protruding tabs at the upper corners that may be inserted into the index tab slots of hanging file folders; or a full length adhesive backed installation tab along the upper edge of the backside that hooks over the top edge of non-slotted file folders. In lieu of an adhesive backed installation tab there may be a full length crimped assembly that clamps over the edge of the file folder. In lieu of folds as suggested unattached means of enclosure of pocket these side edges may be permanently attached.

9 Claims, 8 Drawing Sheets

CUT AWAY

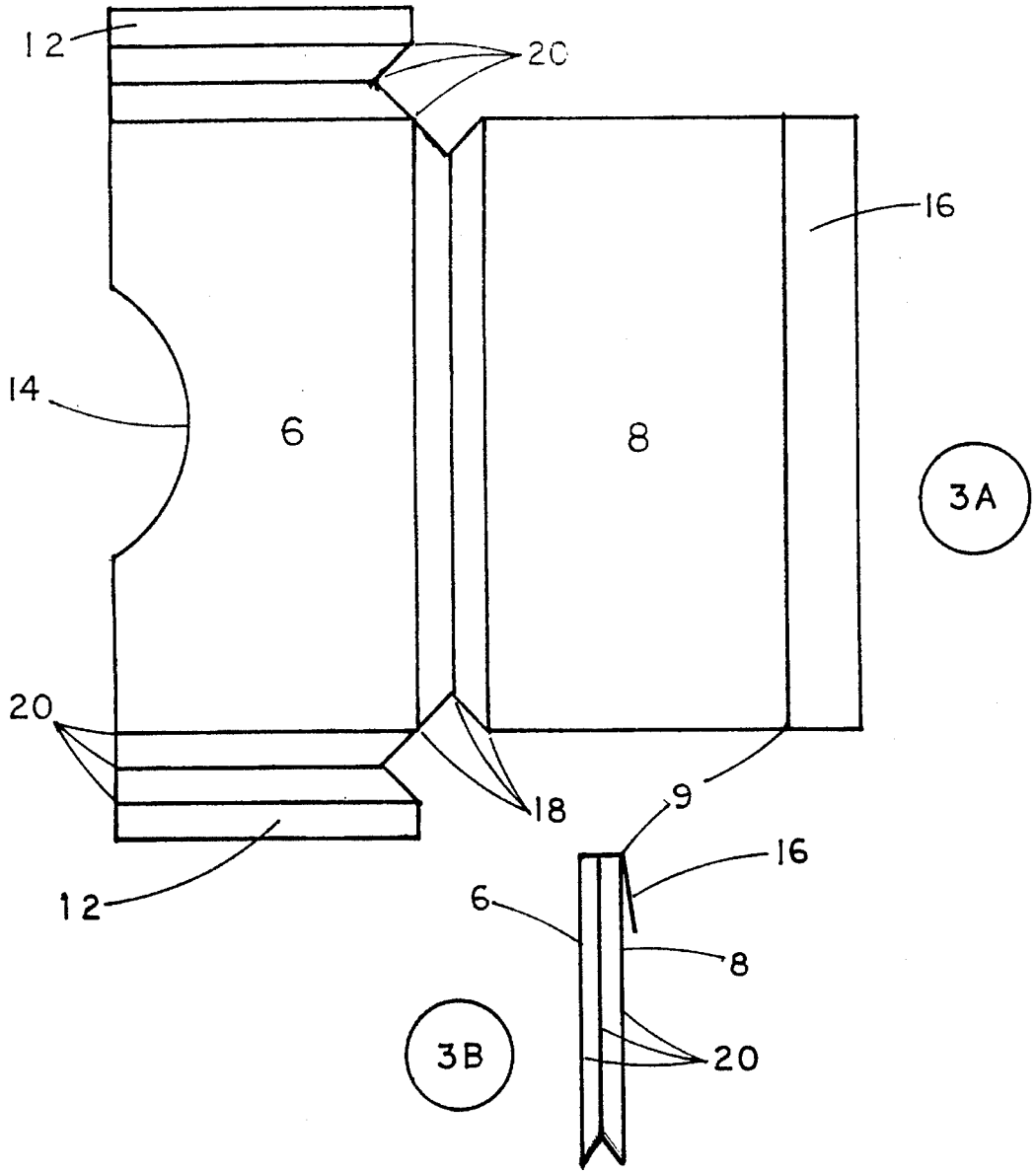
12
20
16
14
6
8
3A
20
18
9
12
16
6
8
3B
20
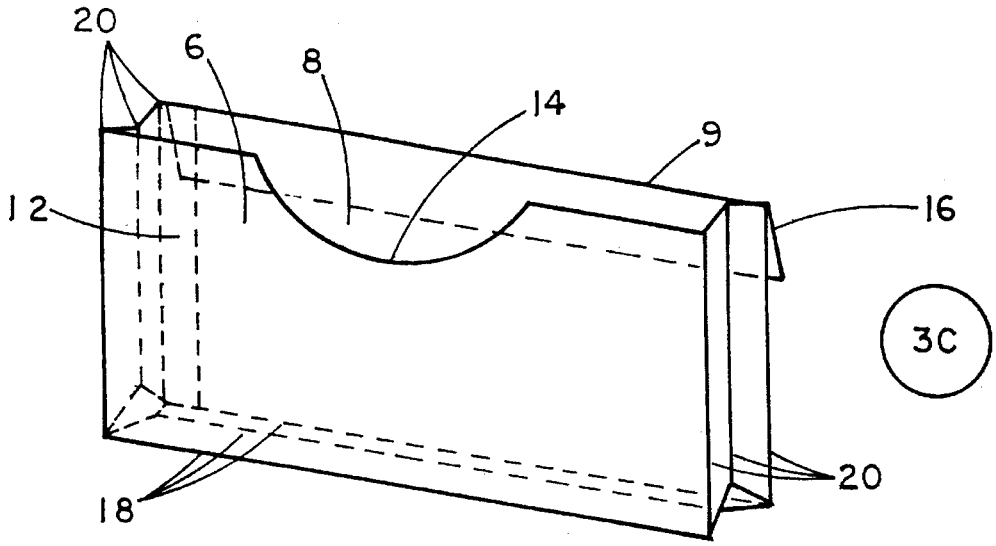
20
6
8
14
9
12
16
3C
18
20

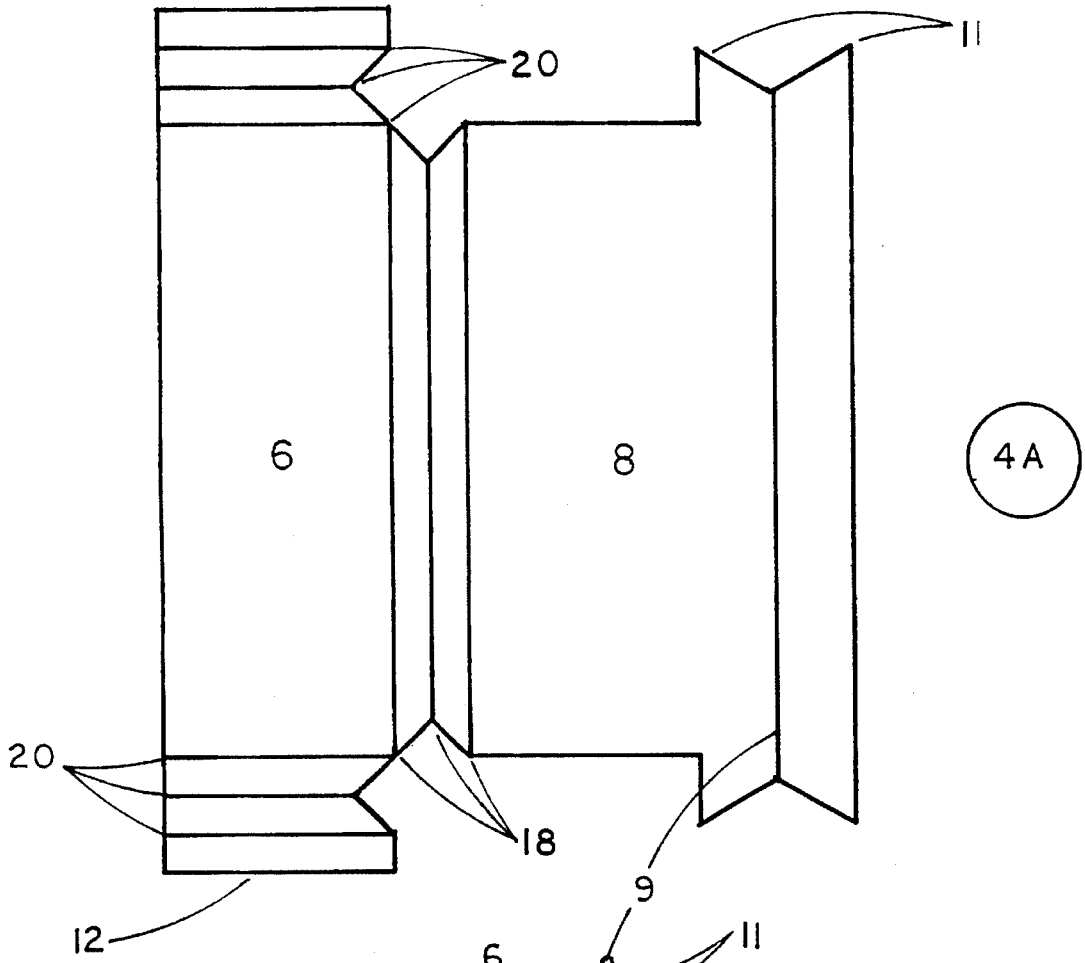
20
11
6
8
4A
20
18
12
9
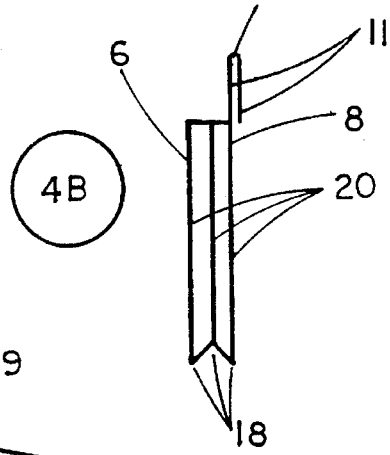
6
11
8
4B
20
18
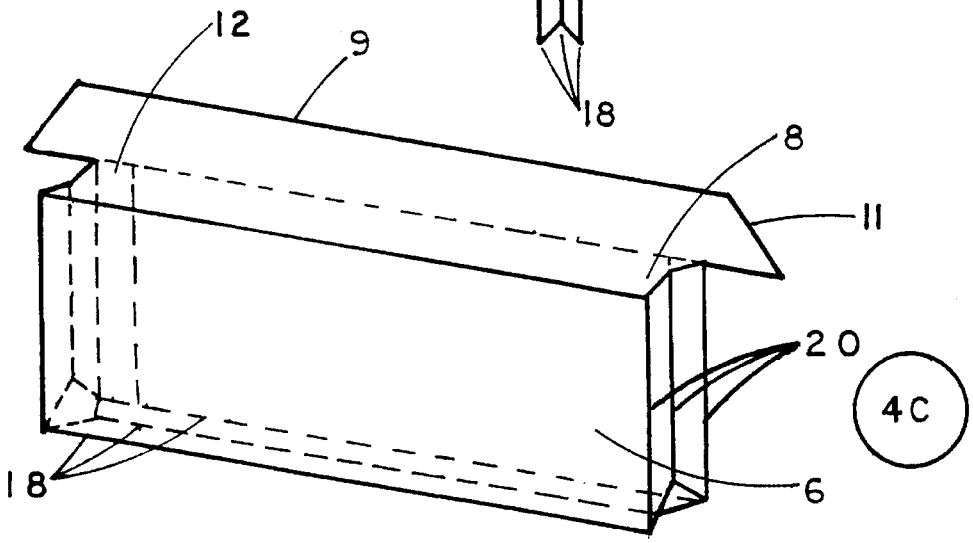
12
9
8
11
20
4C
18
6

STORAGE POCKETS FOR FILE FOLDERS

BACKGROUND—FIELD OF INVENTION

This invention relates to hanging and non-hanging file folders, and to pockets for storing pertinent flat cardlike objects in file folders.

BACKGROUND—DESCRIPTION OF PRIOR ART

A review of the prior art will clearly show the disadvantages of existing systems for storing combined media or formats together and will demonstrate the necessity and utility of the present invention.

U.S. Pat. Nos. 2,291,724 (Jonas), 2,312,717 (Jonas), and 4,053,057 (Snowden) comprise a suspended filing folder has the top edge of at least one side slotted and folded around one suspension bar to accept slot in index tabs.

The index tab disclosed in U.S. Pat. No. 2,291,724 may be mounted in various positions transversely of the folder. The index tabs are preferably made of some transparent material such is commonly employed for this purpose and shaped to form a receptacle for a data slip. They are provided with side ears which are adapted to be slipped into an adjacent pair of slots to support the index tab in place. This tab is a sleeve or pocket designed to hold a single identification slip What is not disclosed is a pocket assembly which has a flexible compartment to allow storage of single or plural pertinent flat card like objects and which is designed to hang, inside the folder, from the top edge.

The index tab disclosed in U.S. Pat. No. 2,312,717 may be mounted at any one of a plurality of transversely spaced points. The index tab may be of any suitable construction. This index tab consists of a body of suitable material comprising a lower portion with transverse wings and an upper offset portion upon which the index data may be directly recorded. Of course the index tab may be constructed in a multitude of known forms, as for example the type comprising a transparent casing into which a data slip may be passed. The index tab is removably attached at the desired point by sliding the transverse wings into a pair of adjacent slots. This patent does not disclose a pocket assembly which has a flexible compartment to allow storage of a single or plural pertinent flat card like objects and which is designed to hang, inside the file folder,from the top edge.

The index tabs disclosed in U.S. Pat. No. 4,053,057 are flexible plastic tabs with resilient locating lugs which are sprung into the slots and held by the material of the folder against the suspension bar so that the latter supports the tab at a desired angle to the folder wall. This index tab, like the tabs above, is designed to attach into the slots along the top edge of the file folder, displaying in a protective sleeve a single identification slip postured visibly above the folder. Again this patent does not disclose a pocket assembly which has a flexible compartment to allow storage of a single or plural pertinent flat card like objects and which is designed to hang, inside the file folder, from the top edge.

U.S. Pat. No. 5,160,296 (Katz) discloses a directory tab comprised of three separate elements: a directory card, a protective panel, and a support strap. The single removable erasable directory card is housed in a rigid plastic frame that is attached to preexisting slots in a suspended file folder. A single element structure folded to form a flexible pocket assembly capable of retaining multiple flat card like objects is not disclosed in this patent.

U.S. Pat. No. 1,317,266 (Bushnell) discloses a adjustable tab protector formed from a single sheet material folded to produce a body and a flange, said body having notches produced therein to form attaching tongues at the (lower) free corners. What this patent does not disclose is a pocket assembly for storing single or plural flat card like objects.

U.S. Pat. No. 4,193,218 (Mermelstein) discloses translucent plastic pages designed for the filing of color film slides. The pages are designed alternatively to be suspended in a file cabinet by means of a hanging bar which affixes to the page. These pages are made out of plastic material by what is known as a vacuum forming process. Each page comprised of a number of rectangular trays, each one of which is adapted for the storage of a single slide. This patent does not disclose a pocket assembly which has a flexible compartment to allow storage of a single or plural flat card like objects and which is designed to hang, inside the file folder, from the top edge of the file folder.

U.S. Pat. No. 4,974,983 (Glvati) discloses a card holder comprised of a binder including a plurality of holder sheets each formed with a plurality of transparent pockets for holding business cards, and a plurality of blank sheets interleaved between the holder sheets, permitting entry of information thereon pertaining to the card held by the exposed holder sheet. What this patent does not disclose is a pocket assembly designed for storing flat card like objects inside a file folder with other pertinent documents.

U.S. Pat. No. 2,384,199 (Sherwood) discloses a billfold which is constructed out of a single piece of material wholly devoid of stitching. The folds are designed to allow the billfold to be constructed by inserting the tabs into various parts of the billfold to create the construction. The tabs are specifically identified as reinforcing the structure of the billfold. Each tab after being put into place, is cemented into place. A pocket assembly designed to hang inside a file folder is not disclosed in this patent.

U.S. Pat. No. 2,403,507 (Dado) discloses a billfold. The major feature of this device is the use of expandable pockets. The specifically disclosed objective of this invention is to provide a billfold which can be constructed of a unitary blank to form one or more expandable pockets without the use of stitching, adhesive or the like. The blank of this invention that is used to form the billfold is designed to fold up so that its tabs will be received in slits at specific portions on the blank. This folding process creates the pocket. What this patent does not disclose is a pocket assembly devoid of integral slits, specifically designed to hang inside a file folder from the top edge of the file folder allowing simultaneous access to pertinent documents.

U.S. Pat. No. 2,767,756 (Niles) discloses a series of individual card receiving pockets. Formed by folding a rectangular flexible plastic sheet nearly in half and heat sealing the top, bottom, and interspersed transverse lines. What this patent does not disclose is a pocket assembly comprising designed means to hang inside a file folder with other pertinent documents.

U.S. Pat. No. 3,295,235 (Tauber) discloses an improved holder finding particular utility in the display of convention badges and the like. A dual compartment holder having a storage compartment and an exposed compartment the design of which eliminates the need for the provision of separate apparel engagement means. The device is mounted by positioning the storage compartment within a pocket, the fold portion between compartments is rested on the pocket edge with the smaller compartment exposed. What this patent does not disclose is a compartment for storing single or plural flat card like objects designed to hang inside a file folder with other pertinent documents.

As seen in the summary of the prior art all cardholders when used in conjunction with file folders suffer from a number of disadvantages:

a) Card holders are either designed to to hold a single or plural card. The plural card holders are comprised of a plurality of staggered or fully offset pockets. Plural pocket configurations use more materials and are especially wasteful if only one or a small fraction of the pockets are needed.

b) Plural capacity card holders formed from one or more pieces of material usually require a combination of construction processes such as folding, heat sealing, cementing, and/or stitching.

c) The card holders are not designed to allow simultaneous access to the cards they contain and pertinent documents stored within a file folder.

d) The card holders are not designed to have a convenient posture or location with the file folder, requiring more time to access desired items.

e) Card holders whether a single pocket or a plurality of pockets allow removal and replacement of one card per pocket at a time, this is slow if one needs to remove or place multiple cards.

f) The existing card holders require either detaching or removing the pocket assembly from a file folder in order to remove or place cards.

OBJECTS AND ADVANTAGES

Accordingly, besides the objects and advantages of the card pockets described in my above patent, several objects and advantages of the present invention are:

a) a single pocket assembly specifically designed to allow storage of single or plural flat card like objects, b) designed to form an expandable pocket from a single sheet of material by means of multiple folds, c) designed to hang inside a file folder from the top edge, d) designed to allow simultaneous access to the contents of the pocket and the pertinent contents of a file folder, e) designed to allow simultaneous removal or placement of plural flat card like objects, f) designed to allow removal and placement of contents without detaching or removing the pocket assembly from the file folder, g) designed to allow easily movable means of attachment, even directly below index tabs (preslotted file folders).

Further objects and advantages will become apparent from a consideration of the ensuing description and drawings.

DRAWING FIGURES

In the drawings closely related figures have the same number but different alphabetic suffixes.

FIGS. 3A to 3C show various aspects of an alternative file pocket assembly for installation in non slotted file folders.

FIGS. 4A to 4C show various aspects of an alternative file pocket assembly for installation in preslotted file folders.

REFERENCE NUMERALS IN DRAWINGS

Figure 1A:
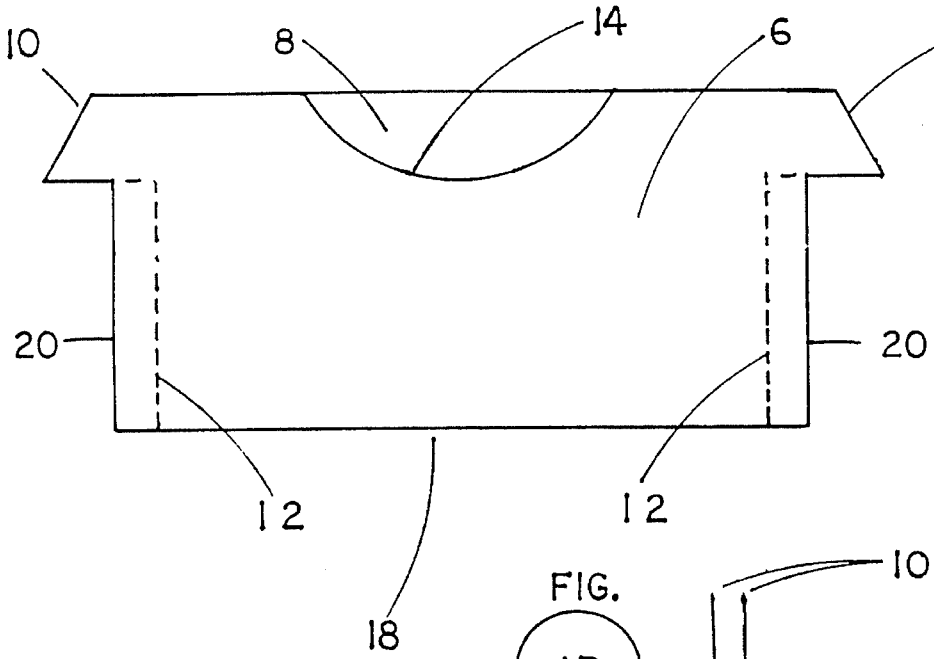
FIGS. 1A to 1D show various aspects of a file pocket assembly for installation in preslotted file folders.

6 front side of pocket
7 top edge fold (front side)
8 backside of pocket
9 top edge fold (backside)
10 installation tab; preslotted file folders
11 installation tab, double-ply; preslotted file folders
12 side flap
14 easy access cut-out
15 curved flap
16 installation tab; non-slotted file folders
18 bottom fold
20 side fold

DESCRIPTION—FIGS. 1 to 4

Figure 1B:
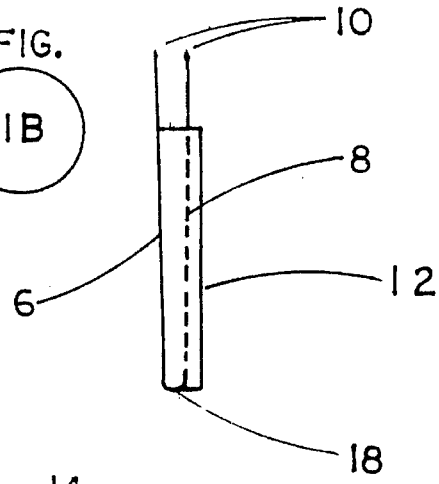
Figure 1C:
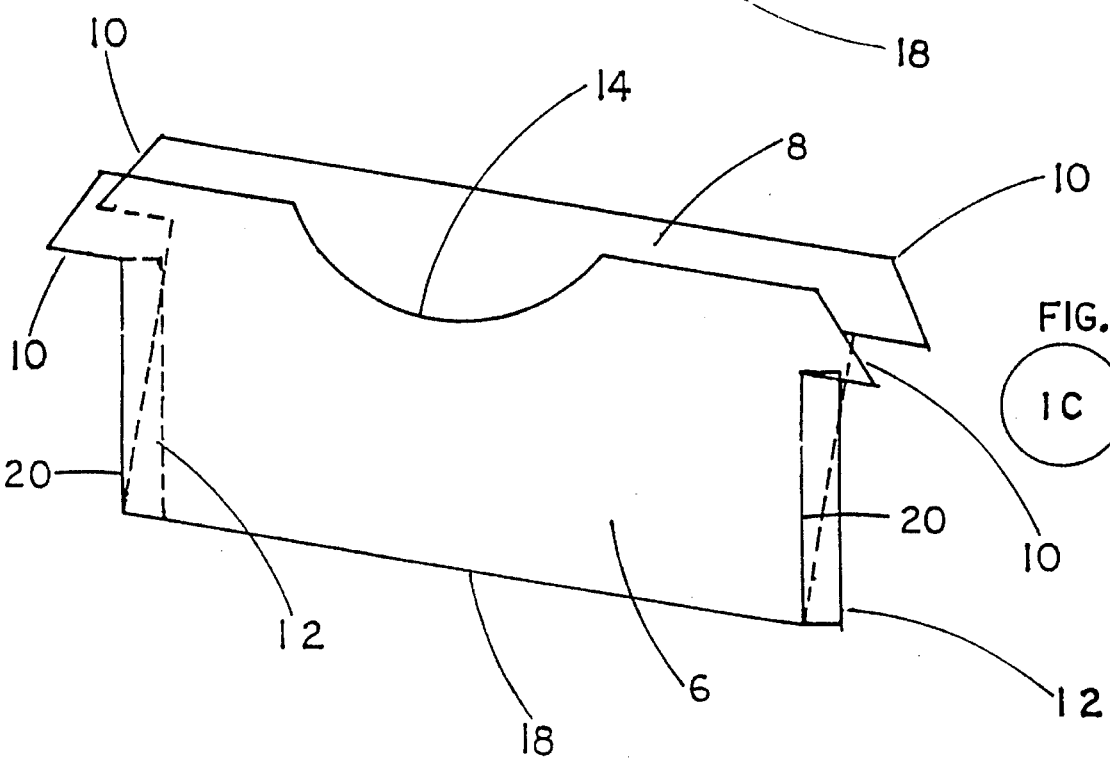
Figure 1D:
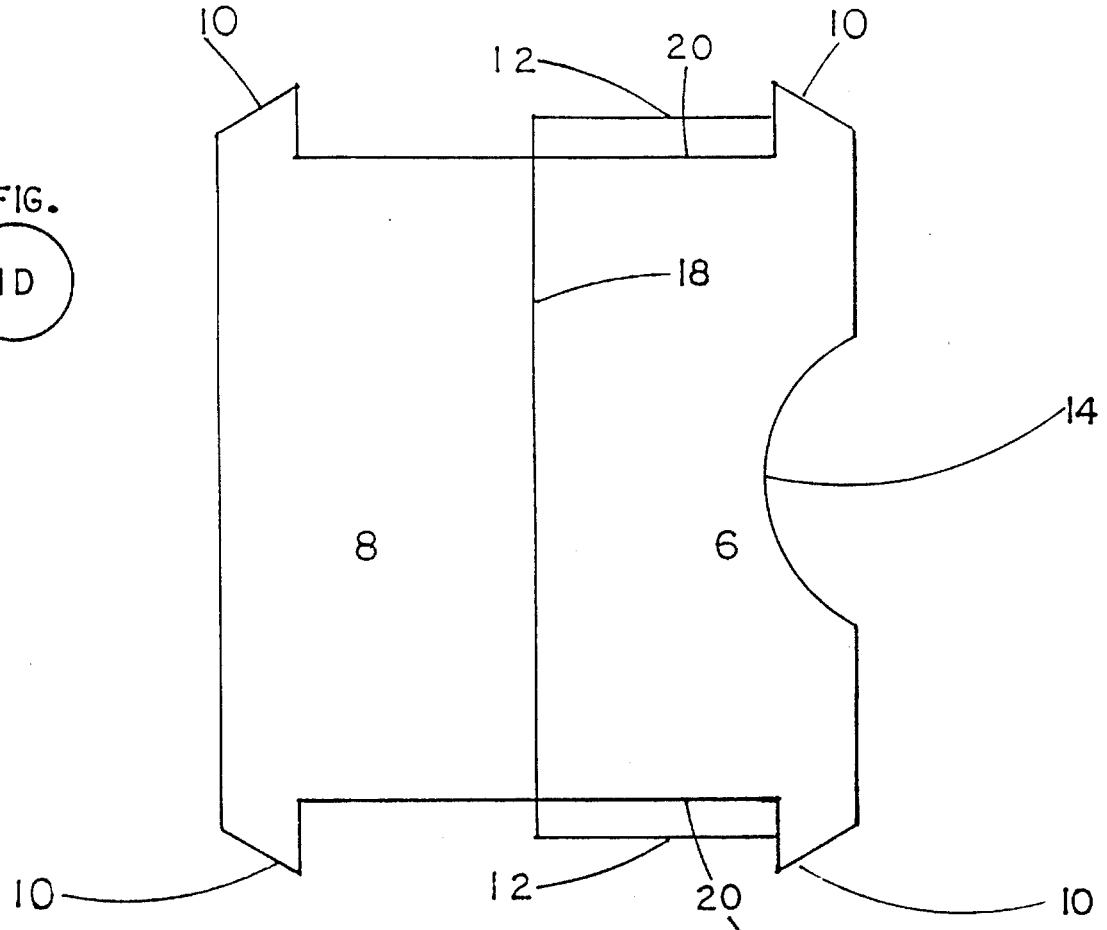

A typical embodiment of the file pocket of the present invention is illustrated in FIG. 1A (front view), FIG. 1B (side view), FIG. 1C (perspective view), FIG. 1D (pattern view). Using the pattern the pocket is cut from a single sheet of transparent semi-flexible plastic composite film such as acetate. However the sheet for the pocket assembly can be any other semi-flexible material or combination of materials that can be repeatedly manipulated without deforming such as polyethylene, polypropylene, vinyl, nylon, rubber, leather, various impregnated or laminated fibrous materials, various plasticized materials, cardboard, paper, etc.

The resulting cut blank is then folded on lines 18 and 20 forming the bottom and sides of the pocket. The bottom fold 18 connects the front side 6 and the backside 8 of the pocket. The side folds 20 form the side flaps 12 which close the pocket by tucking behind and retaining the backside 8. Although it is not necessary the side flaps 12 may be cemented, heat sealed, or otherwise permanently fastened to the backside 8. Protruding from the upper corners of the pocket are the Installation tabs 10 which enable the pocket to be movably attached inside the preslotted file folder. Centered along the top edge is the easy access cutaway 14 which facilitates removal and placement of the pocket contents.

Additional embodiments of pockets for use with preslotted file folders are shown in FIGS. 1E to 1H and FIGS. 4A to 4C.

Figure 1E:
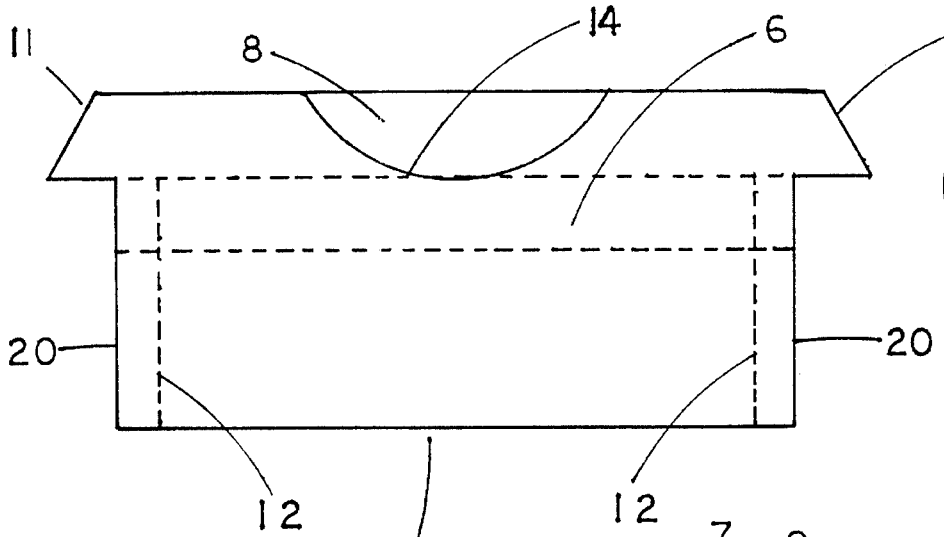
FIGS. 1E to 1H show various aspects of a reinforced file pocket assembly for installation in preslotted file folders.
Figure 1F:
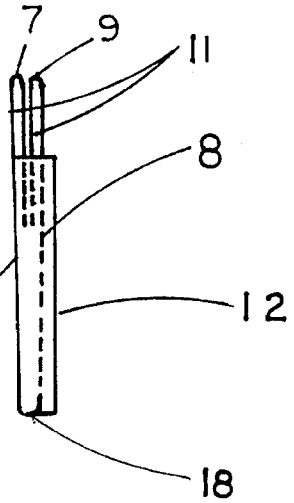
Figure 1G:
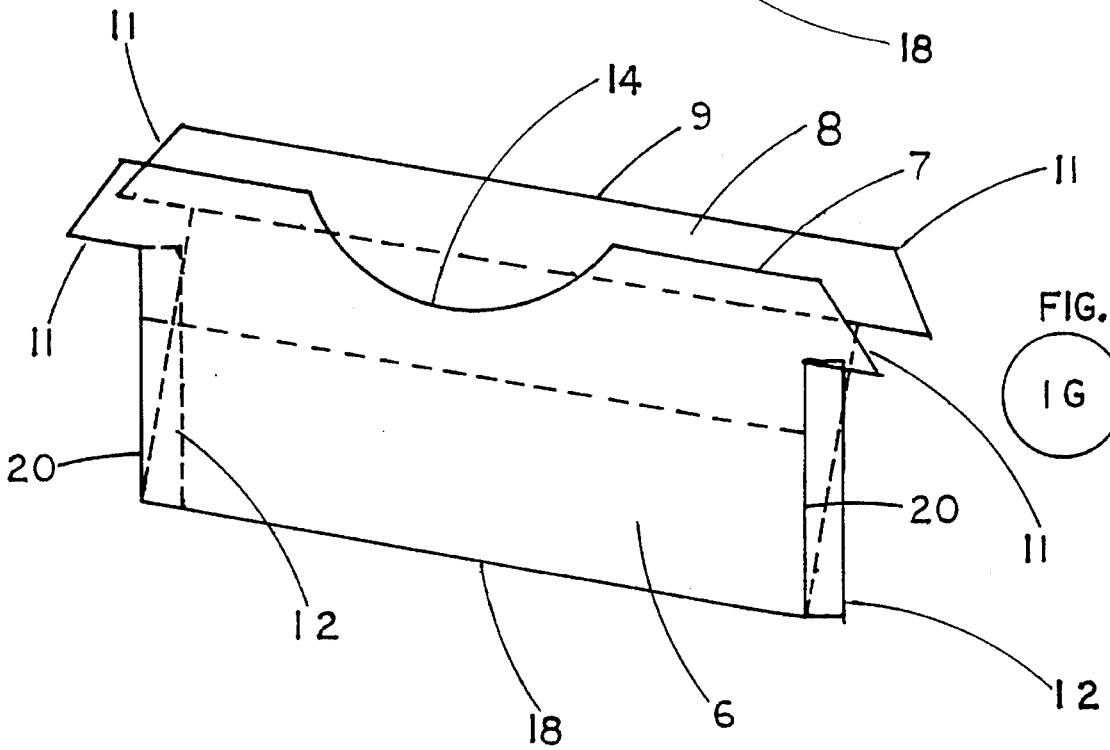
Figure 1H:
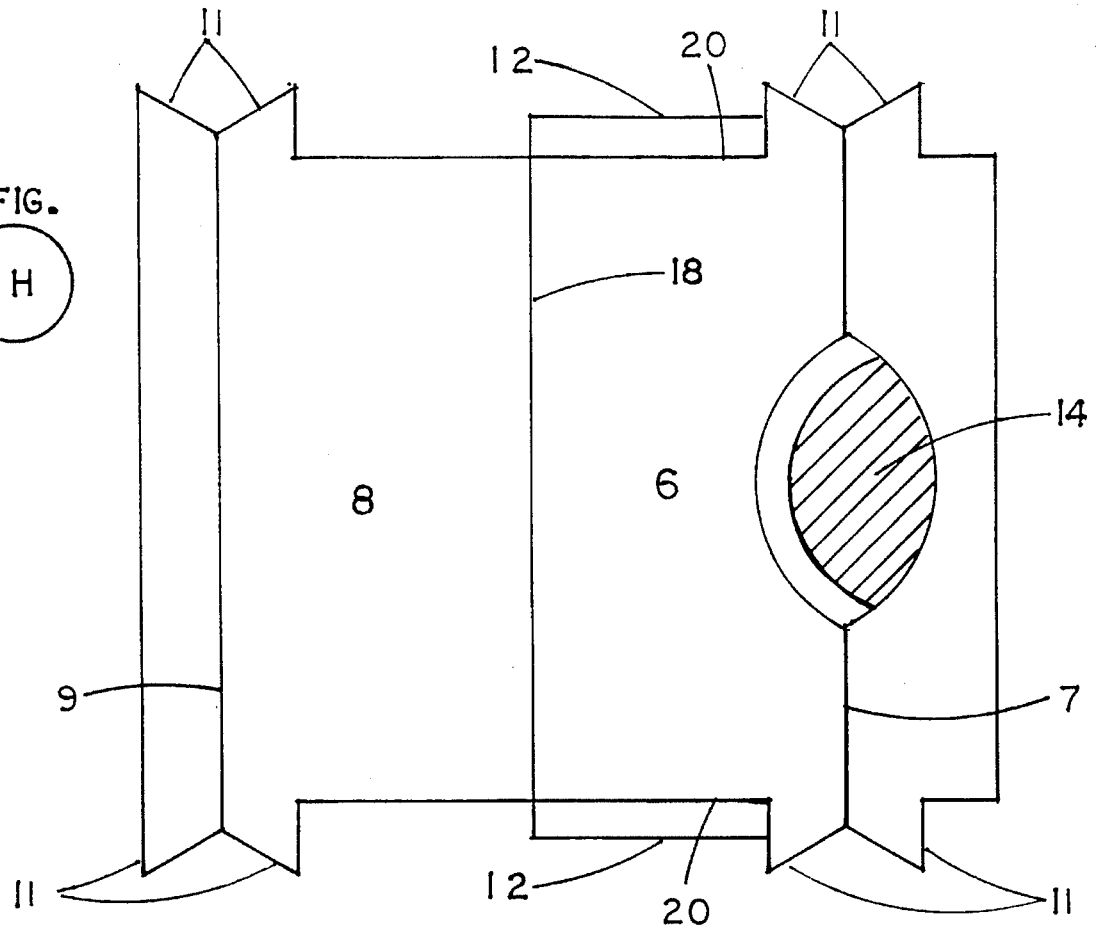

A reinforced version of the pocket for preslotted file folders described in FIGS. 1A to 1D is shown in FIG. 1E(front view), FIG. 1F(side view), FIG. 1G(perspective view), and FIG. 1H(pattern view). Reinforcement of the pocket is achieved by an additional fold 7 at the top edge of the front side 6 and an additional fold 9 at the top edge of the backside 8, these folds effectively double the material at these areas. On the backside 8 this doubled material runs only as deep as the installation tabs themselves. The doubled material on the front side 6 runs deeper into the pocket to allow reinforcement of the easy access cutout 14 as well as the installation tabs 10. In the cutout 14 there is a curved flap 15 that folds over the doubled top edge of the cutout to stiffen and seal this edge to avoid snagging of cardlike articles during placement.

In FIG. 4A(pattern view), FIG. 4B(side view), and FIG. 4C(perspective view) a larger capacity pocket assembly for preslotted file folders is shown. Like the others, this pocket is cut from a single sheet of material according to the pattern. However, instead of single folds at 18 and 20 there are multiple folds which give the bottom and side of the pocket assembly an accordion like characteristic flexibility. The increased flexibility, introduced by the side folds 20, requires permanently attaching the side flaps 12 to the backside 8. Because this configuration allows installation tabs on the backside only, this area should be reinforced by introducing the fold 9 which effectively doubles the material comprising the top edge of the backside and the installation tabs.

The various embodiments of pocket assemblies for use with non-slotted file folders and the like are illustrated in FIGS. 2A to 2D, FIGS. 2E to 2H, and FIGS. 3A to 3C.

Figure 2A:
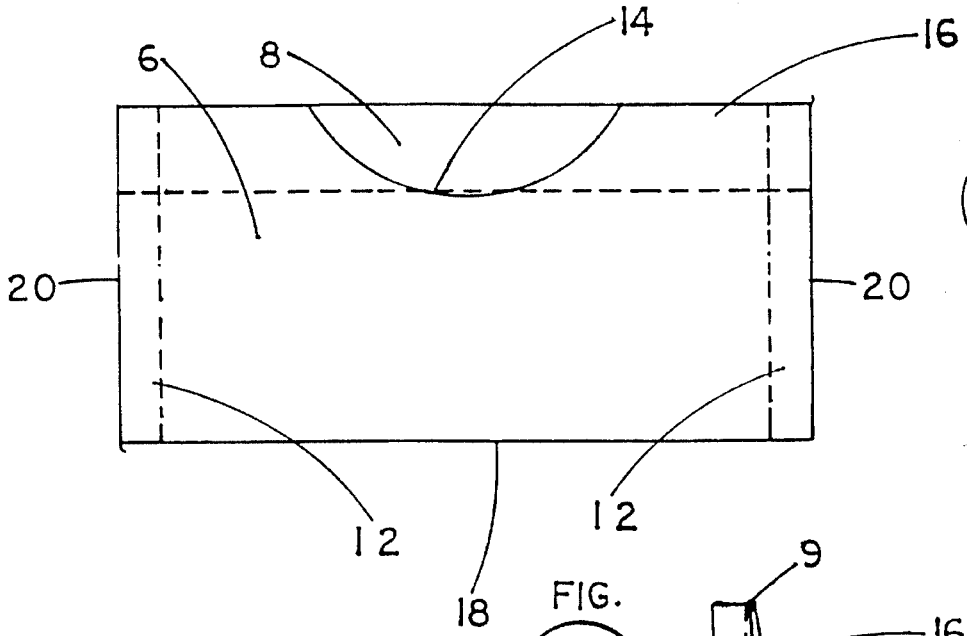
FIGS. 2A to 2D show various aspects of a file pocket assembly for installation in non-slotted file folders.
Figure 2B:
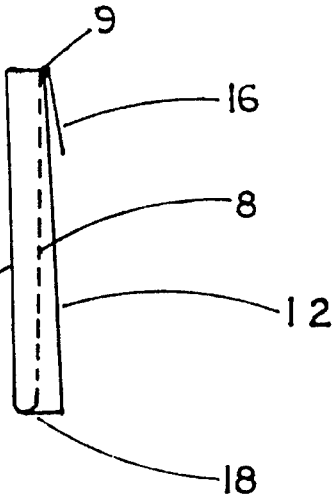
Figure 2C:
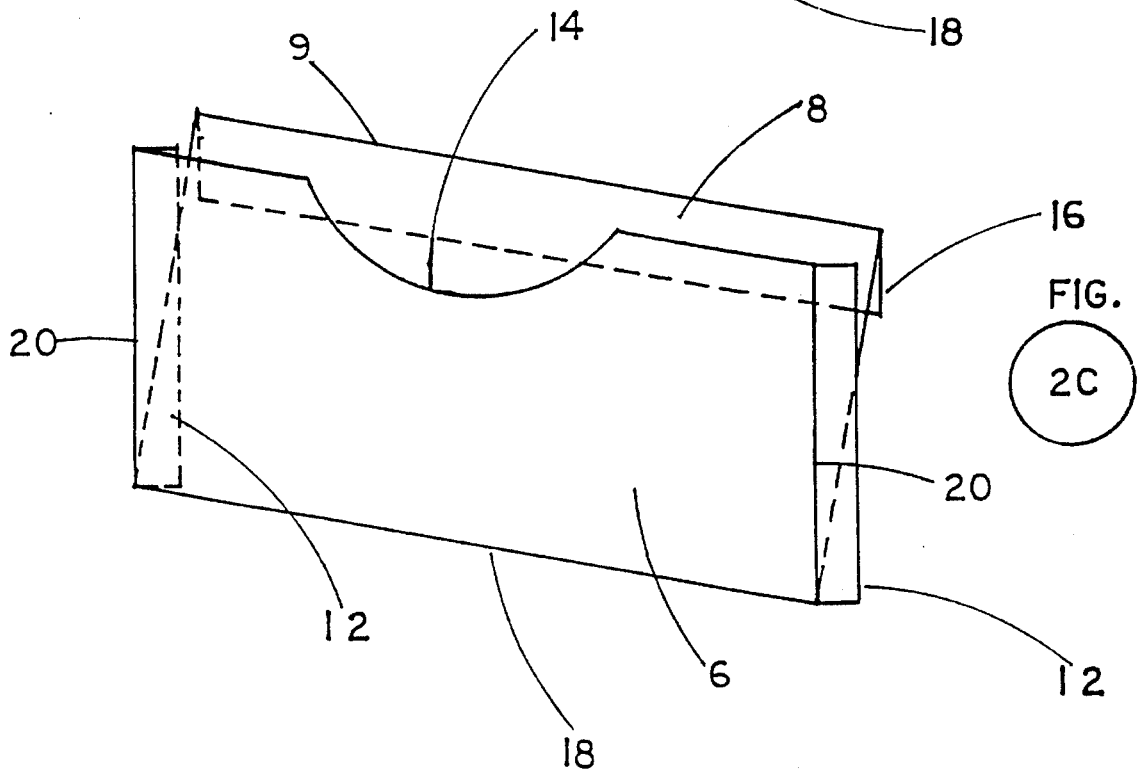
Figure 2D:
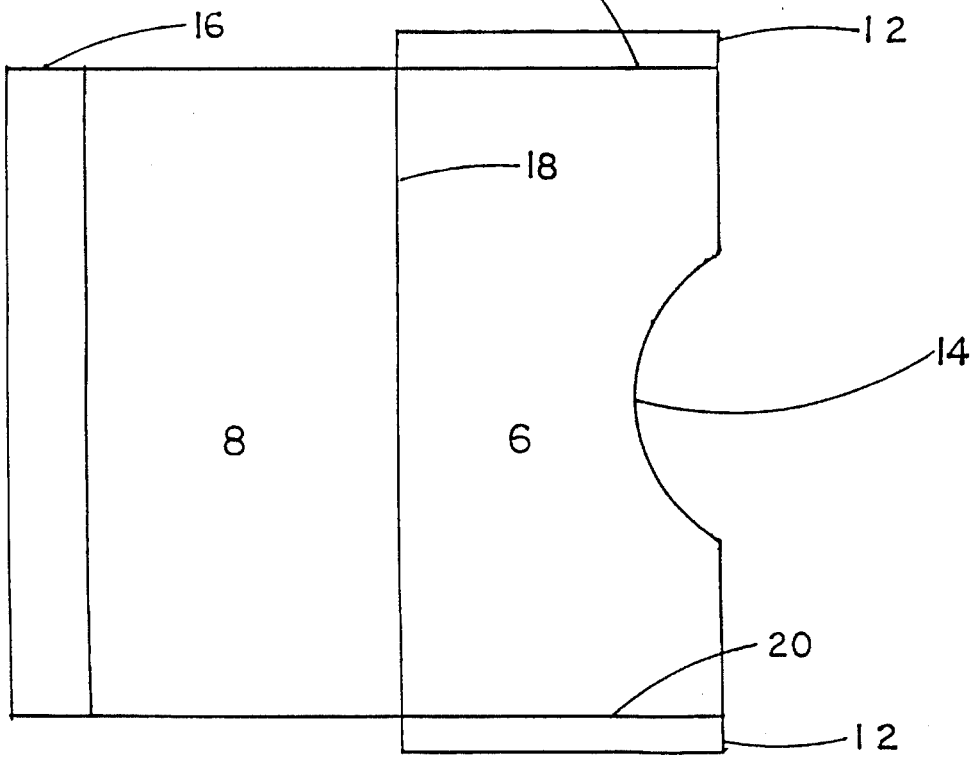

The simplest pocket assembly for use with non-slotted file folders is illustrated in FIG. 2A(front view), FIG. 2B(side view), FIG. 2C(perspective view), and FIG. 2D(pattern view). Using the pattern the pocket is cut from a single sheet of material. The resulting cut blank is then folded on lines 18 and 20 forming the bottom and sides of the pocket. The bottom fold 18 connects the front side 6 and the backside 8 of the pocket. The side folds 20 form the side flaps 12 which close the pocket by tucking behind and retaining the backside 8. Although it is not necessary the side flaps 12 may be cemented, heat sealed, or otherwise permanently fastened to the backside 8. By making a full length fold 9 along the top edge of the backside 8 the installation tab 18 is formed. The backside of this installation tab 18 should be coated with a non-permanent adhesive allowing the pocket assembly to be movably attached to the top edge of the non-slotted file folder.

Figure 2E:
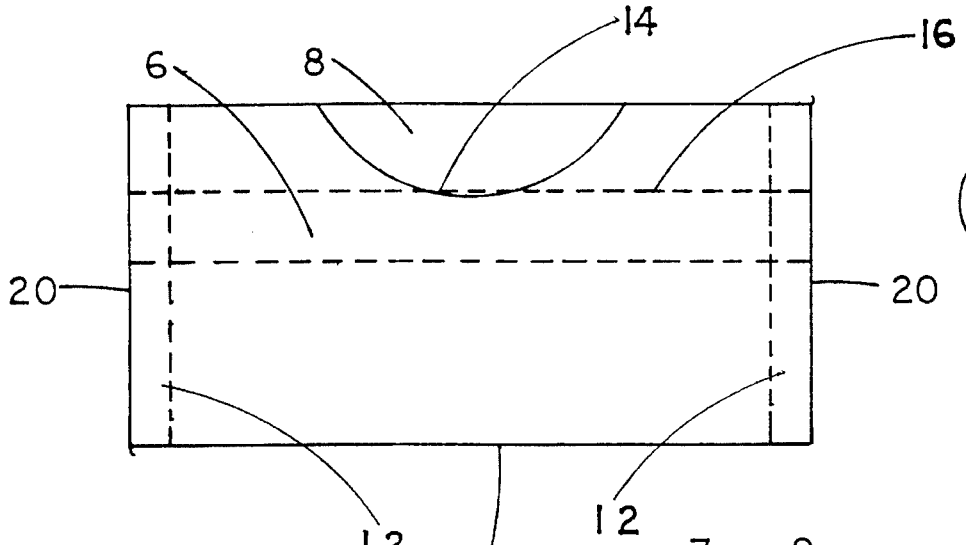
FIGS. 2E to 2H show various aspects of a reinforced file pocket assembly for installation in non slotted file folders.
Figure 2F:
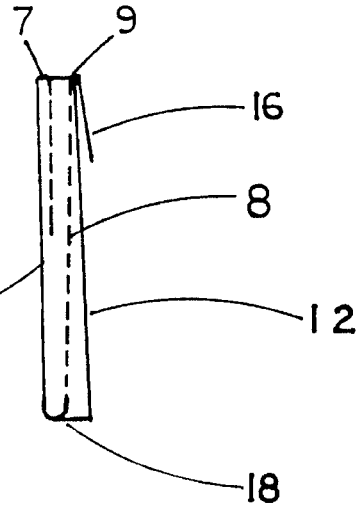
Figure 2G:
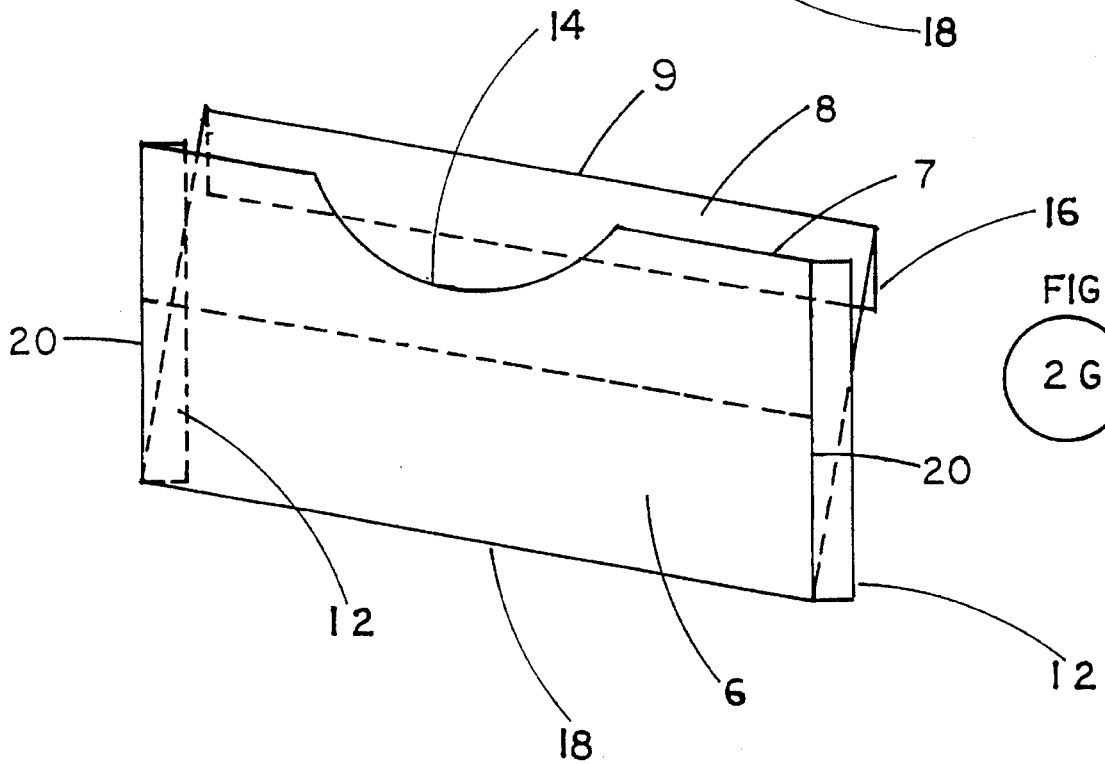
Figure 2H:
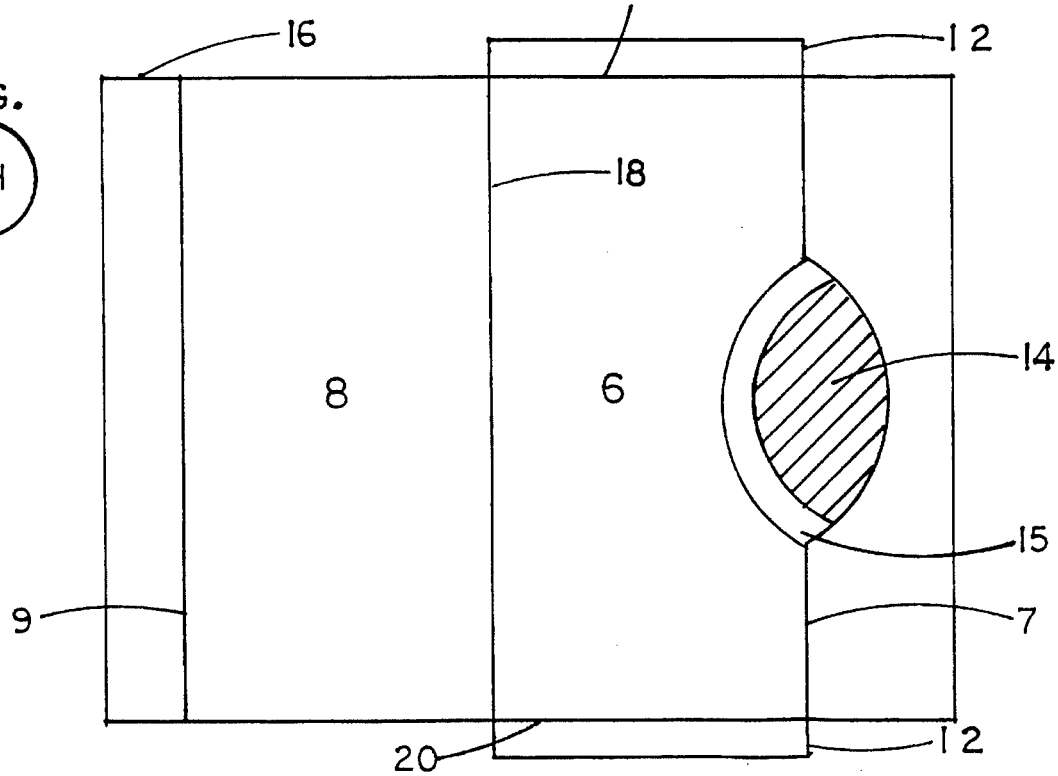

A reinforced version of this pocket assembly is illustrated in FIG. 2E(frontview), FIG. 2F(side view), FIG. 2G(perspective view), and FIG. 2H(pattern view). Reinforcement of the pocket is achieved by an additional fold 7 at the top edge of the front side which effectively doubles the material, stiffening the top edge of the front side and the easy access cutout 14. In the cutout 14 there is a curved flap 15 that folds over the doubled top edge of the cutout to stiffen and seal this edge to avoid snagging of contents during placement.

A larger capacity pocket assembly for non-slotted file folders is illustrated in FIG. 3A(pattern view), FIG. 3B(side view), and FIG. 3C(perspective view). As the others this pocket is cut from a single sheet of material according to the pattern. However instead of single folds at 18 and 20 there are multiple folds which give the bottom and side of the pocket assembly an accordion like characteristic flexibfiity. Because of the increased flexibility, introduced by the side folds 20, this configuration requires the permanent attachment of the side flaps 12 to the backside 8.

These FIGS. 1 to 4 show only a suggested orientation of the flat cardlike contents of the file pocket in which the longer side of the card runs parallel to the top edge of the file folder and the shorter side of the card runs perpendicular to the top edge of the file folder. This orientation could be rotated 90 degrees with larger card like objects where the shorter side is sufficiently large enough to be easily accessed and the printed matter on the card does not ultimately dictate otherwise such as 3.5 in.×5.0 in. or 4.0 in.×6.0 in. photographs. This rotated orientation allows more efficient use of the slots of the file folder increasing choices of pocket location and possibly allowing adjacent installation of multiple pockets. This rotated orientation is especially efficient if the pocket is intended to hold high-aspect oblong cardlike objects where the long side is much longer than the short side such as personal checks or strips of film negatives.

OPERATION—FIGS. 1 TO 6

The manner of installing the file pockets in a file folder is most closely related to installing the index tabs in a file folder.

To install a file pocket (FIGS. 1 and FIGS. 4) within a preslotted file folder, first one of the installation tabs 10 is placed in the selected slot located at the top edge of the file folder, next the file pocket is manually deformed to effectively shorten the pocket so the second index tab 10 may be inserted in the appropriate corresponding slot. Removal procedure is the same as the installation procedure in reverse.

To install a file pocket (FIGS. 2 and FIGS. 3) in a non-slotted file folder, first tile desired location along the top edge of the file folder is determined, next the protective paper covering the non-permanent adhesive on the backside of the installation tab 16 is removed, then the fold 9 is set on the edge of the file folder of so that the installation tab 16 and the backside 8 of the file pocket are on opposite sides of the wall of the file folder the installation tab 16 is then pressed tight to the back of the file folder adhering the pocket in place. To remove the file pocket the installation tab 16 must be pealed away from the wall of the file folder, disengaging the adhesive, before the pocket is moved.

SUMMARY, RAMIFICATIONS, AND SCOPE

Accordingly, the reader will see that the card pocket of this invention can be used to store single or plural card like objects conveniently inside a file folder along with other pertinent documents stored within the file folder. Furthermore, tile file pocket has the additional advantages in that,

- it can be formed from a single sheet of material by means of cutting and folding;
- it is a flexible single pocket assembly capable of storing plural card like objects;
- it is designed to hang at the inside top edge of the file folder;
- it is designed to allow simultaneous removal or placement of plural flat card like objects;
- it is designed to allow removal and placement of the contents of the pocket without detaching or removing the pocket assembly from the file folder;
- it is designed to allow easily movable means of attachment.

Although the description above contains many specificities, these should not be construed as limiting the scope of the invention but merely as providing illustrations of some of the presently preferred embodiments of this invention. For example,

- the pocket assembly could include an integral index tab,
- the installation tab 16 could be replaced by a crimped non-adhesive assembly allowing the pocket to clamp to the top edge of the file folder,
- the pocket assembly could be comprised of multiple staggered single capacity card pockets,
- the easy access cutout 14 could be eliminated and the height of the front side 6 could be shortened to expose and facilitate access to the pocket contents, as is the case with the pocket configuration illustrated in FIGS. 4,
- the pocket assembly could be formed from multiple pieces of material joined together rather than being formed from a folded single sheet of material the side flaps 12 could be permanently attached to the backside 8, as is necessary with the pocket configurations illustrated in FIGS. 3 and FIGS. 4, the pocket may be close to a square rather than oblong or rectangular allowing storage of floppy discs or other squarish flat card like objects.

Thus tile scope of the invention should be determined by the appended claims and their legal equivalents, rather than by the examples given.

I claim:

1. A pocket assembly to hang from an upper portion of a file folder and hold a flat, card-like object, comprising:

a sheet of semi-flexible material folded to form opposed front and back walls joined by the fold at their lower edges, said back wall having an upper portion including means for attachment to the upper portion of said file folder and said edges, and said front wall having side edges.

2. The pocket assembly of claim 1 wherein said means for attachment comprises a protruding installation tab extending from each upper corner of said front and back wall.

3. The pocket assembly of claim 1 wherein said front wall includes a top end that has a cutout that facilitates removal of said card-like object from said pocket.

4. The pocket assembly of claim 1 wherein said side edges of said front wall are folded back to form side flaps which tuck behind said back wall.

5. The assembly of claim 1 wherein said means for attachment comprises a folded-back portion of said upper portion of said back wall configured to embrace said top edge of said file folder.

6. The pocket assembly of claim 5 wherein the underside of said folded-back portion is coated with a non-permanent adhesive.

7. The pocket assembly of claim 5 wherein said folded-back portion is crimped to clamp over said top edge of said file folder.

8. The pocket assembly of claim 4 wherein said side flaps include multiple folds and said side flaps are permanently joined to said back wall, whereby said pocket may expand and contract with an accordion action.

9. A pocket assembly to hang from an upper portion of a file folder and to hold a flat, card-like object, comprising:

a sheet of semi-flexible material folded to form opposed front and back walls joined by the fold at their lower edges, said back wall having an upper portion including a protruding installation tab extending from each upper corner of said side walls, and said from wall having side edges.

* * * * *

UNITED STATES PATENT AND TRADEMARK OFFICE

CERTIFICATE OF CORRECTION

PATENT NO. : 5,545,087

DATED : Aug. 13, 1996

INVENTOR(S) : Eric Seward

It is certified that error appears in the above-identified patent and that said Letters Patent is hereby corrected as shown below:

Column 2 line 19 change "Glvati" to --Givati--; line 37 change "Dado" to --Davio--.

Column 5 line 48 change "flexibfitty" to --flexibility--.

Column 6 line 15 change "tile" to --the--; line 33 change "tile" to --the--.

Column 7 line 7 change "tile" to --the--.

Column 8,

Claim 9 line 9 change "from" to --front--.

Signed and Sealed this

Thirty-first Day of December, 1996

Bruce Lehman

*Attest:*

BRUCE LEHMAN

*Attesting Officer*

*Commissioner of Patents and Trademarks*